United States Patent [19]

Gilberto

[11] Patent Number: 5,009,132

[45] Date of Patent: Apr. 23, 1991

[54] TORQUE DEVICE

[75] Inventor: Daniel G. Gilberto, Newington, Conn.

[73] Assignees: Robert A. Grant; Douglas A. Bourque; Mildred T. Felt, all of Fitchburg, Mass. ; a part interest

[21] Appl. No.: 531,114

[22] Filed: May 31, 1990

[51] Int. Cl.[5] ..... B25B 17/00

[52] U.S. Cl. ..... 81/57.3; 74/143; 81/57.31

[58] Field of Search ..... 74/143; 81/57, 57.29–57.31, 81/57.39, 61, 62

[56] References Cited

U.S. PATENT DOCUMENTS

| | | | |
|---|---|---|---|
| 2,634,630 | 4/1953 | Johnson | 81/57.31 X |
| 2,641,136 | 6/1953 | Marsden, Jr. et al. | 81/57.31 X |
| 4,644,829 | 2/1987 | Junkers | 81/57.39 |
| 4,671,142 | 6/1987 | Junkers | 81/57.39 |
| 4,846,027 | 7/1989 | Lu | 81/57.3 |

FOREIGN PATENT DOCUMENTS

| | | | |
|---|---|---|---|
| 788336 | 12/1957 | United Kingdom | 81/57.3 |

*Primary Examiner*—James G. Smith

*Attorney, Agent, or Firm*—Blodgett & Blodgett

[57] ABSTRACT

Device in the nature of a wrench or the like in which reciprocatory rotary motion is converted to continuous rotation in one direction.

10 Claims, 4 Drawing Sheets

TORQUE DEVICE

BACKGROUND OF THE INVENTION

In the design and operation of tools and machinery, there are many situations where it is desirable to convert reciprocatory rotary motion to continuous rotary motion in one direction. A typical example is in the case of a socket wrench in which situation the operator moves the actuating handle back and forth in an arc of around 30°. In the conventional socket wrench, the force and torque is transmitted in one direction when the handle is moved in that direction but on the return stroke no torque is applied. This can lead to a number of problems, not the least of which is that, in the case of turning a bolt, the drag on the return stroke may cause the bolt to unscrew by almost the amount that it has been tightened on the first stroke. Therefore, it becomes necessary to hold the bolt with the fingers during the non-torquing direction of the handle motion; in many instances, this is not only awkward, but also dangerous. In some situations, also, the returning of the handle during the torquing stroke causes an impact of the socket on the bolt, particularly when there is a loose fit between the bolt head and the socket. This can not only cause damage to the bolt head, but also, in the long run, causes deformation and damage to the socket. These and other difficulties experienced with the prior art devices have been obviated in a novel manner by the present invention.

It is, therefore, an outstanding object of the invention to provide a torque device in which reciprocatory rotary motion is converted to continuous rotation in one direction.

Another object of this invention is the provision of a socket wrench in which swinging motion of the handle produces continuous rotation of the socket in a desired direction.

A further object of the present invention is the provision of a socket wrench in which continuous torquing pressure is produced on the output socket during both swinging motions of the handle.

It is another object of the instant invention to provide a torque wrench which is simple in construction, which can be manufactured inexpensively, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a torque device, such as a socket wrench, having first and a second disk-like housings located in a generally parallel, spaced relationship, having a third generally-annular intermediate housing that is sandwiched between them, and having a radial handle for rotating the intermediate housing about a main axis. A first means is provided for joining the intermediate housing with both outer housings to rotate them in a second direction about a main axis when the handle is moved in a first direction and a second means is provided for joining the intermediate housing to the outer housings to rotate them in the second direction when the intermediate housing is moved in the second direction.

More specifically, a ring lies within the intermediate housing, is guided for rotation about the main axis; it has ratchet teeth on its outer periphery and gear teeth on its inner periphery. A cluster of planetary gears is mounted in the intermediate housing, the gears engaging the gear teeth on the inner periphery of the ring. A sun gear extends axially out of the main axis and is fastened to both outer housings, while engaging the planetary gears.

A series of pawls are mounted on the intermediate housing engaging the ratchet teeth on the outer periphery of the ring to drive the ring in the said first direction. A series of pawls are also mounted on the intermediate member to drive ratchet teeth on the outer housings in the second direction when the intermediate housing is driven in the second direction.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
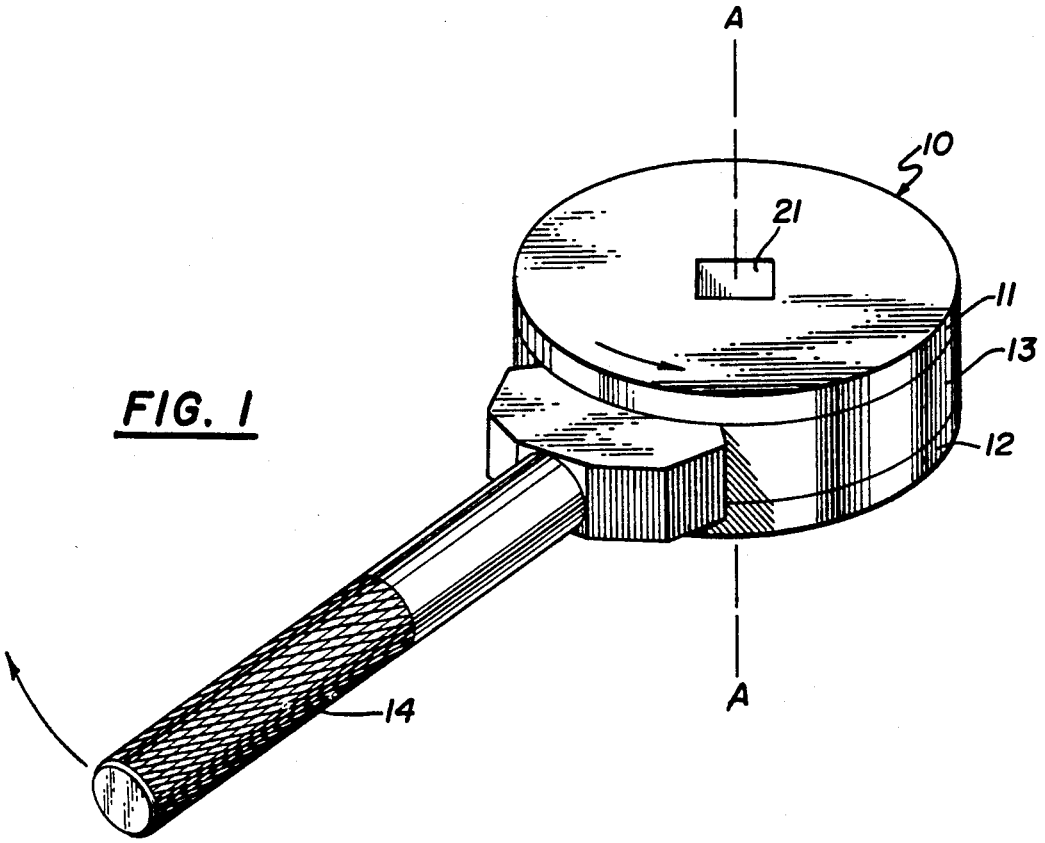
FIG. 1 is a perspective view of a torque device incorporating the principles of the present invention.
Figure 2:
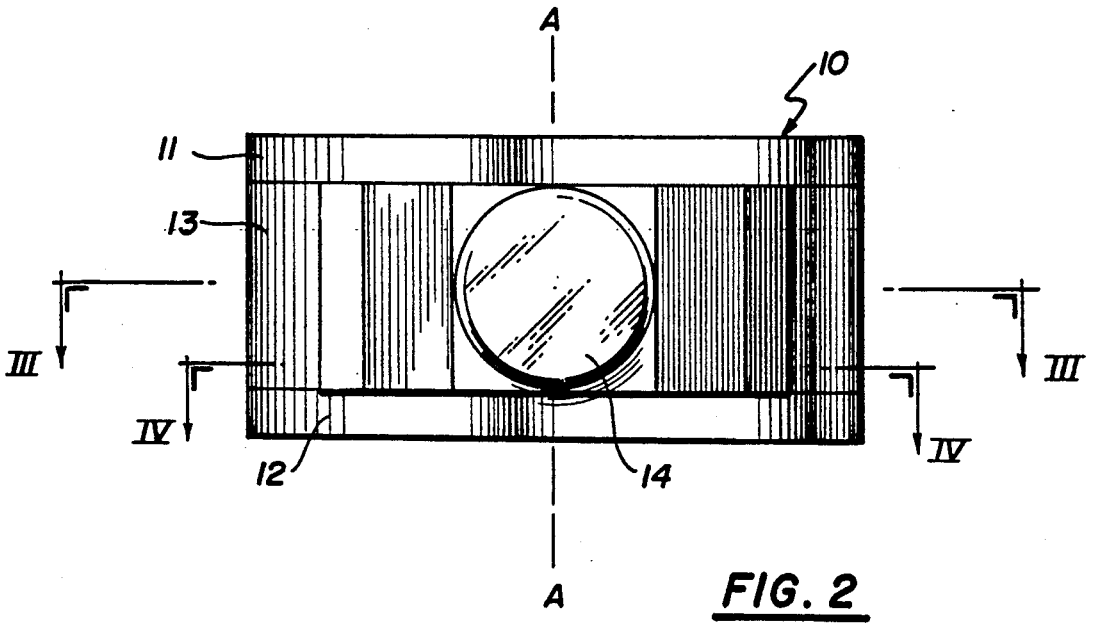
FIG. 2 is a front elevational view of the torque device.

Referring first to FIGS. 1 and 2, which best show the general features of the invention, the torque device, indicated generally by the reference numeral 10, is shown as comprising a first outer disk-shaped housing 11 and a second outer disk-shaped housing 12, which housings are located in a generally-parallel, spaced relationship. A third annular intermediate housing 13 is sandwiched between and joins the first and second housings. The intermediate housing has a radial handle 14 for rotating it about a main axis A—A.

Means is provided joining the intermediate housing 13 to both outer housings 11 and 12 to rotate them in a second direction when the intermediate housing is rotated in a first direction. Means is also provided joining the intermediate housing to the outer housings to rotate both outer housings in the second direction when the intermediate housing is rotated in the second direction.

Figure 3:
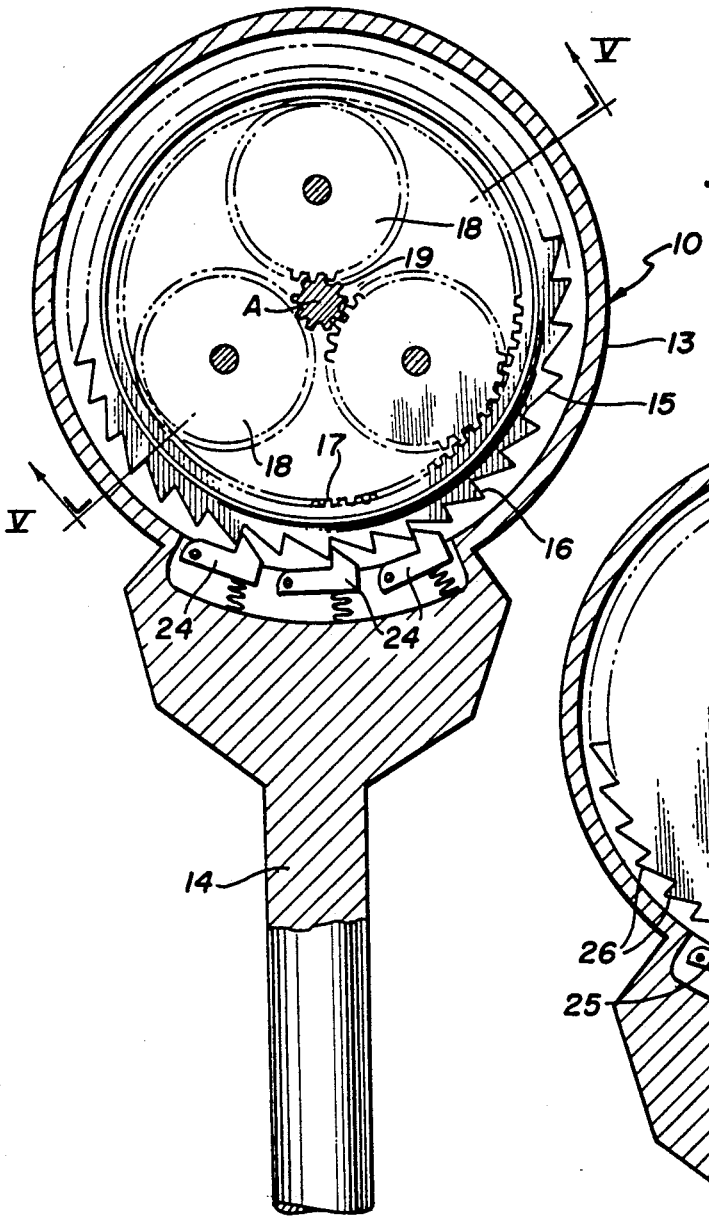
FIG. 3 is a horizontal sectional view of the device taken on the line III—III of FIG. 2.
Figure 4:
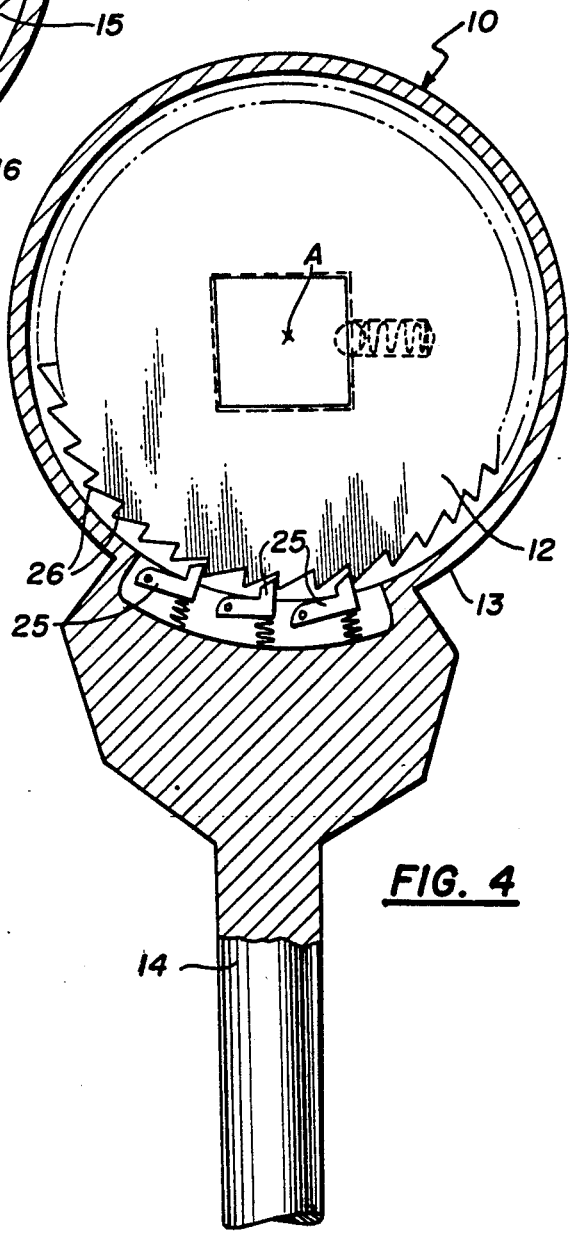
FIG. 4 is horizontal sectional view of the device taken on the line IV—IV of FIG. 2.
Figure 5:
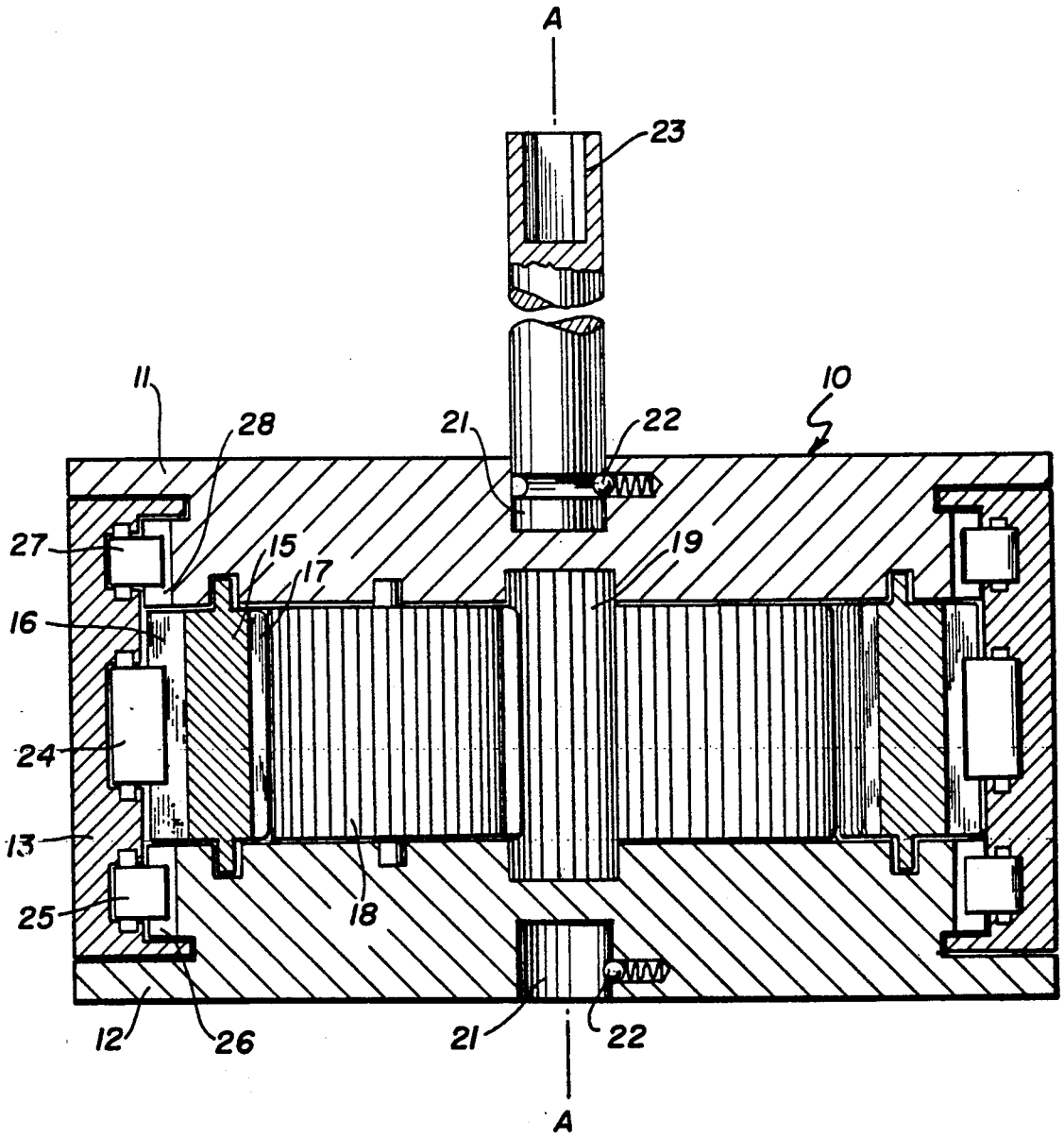
FIG. 5 is a vertical sectional view of the invention taken on the line V—V of FIG. 3.
Figure 6:
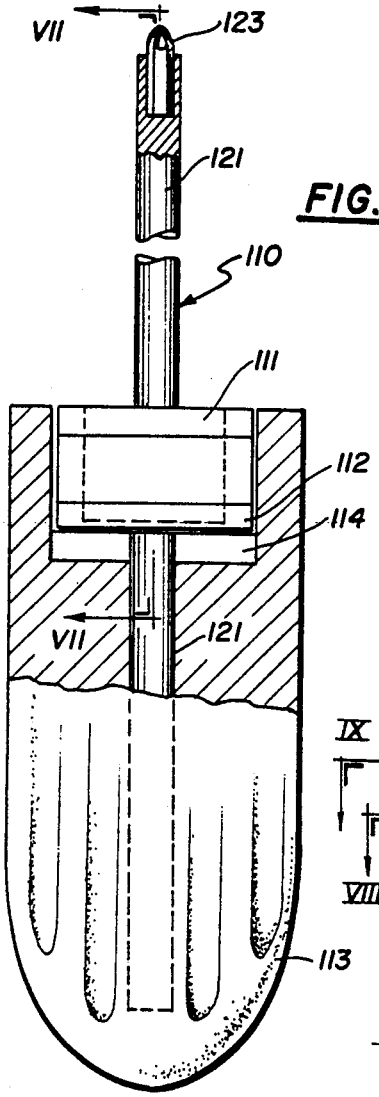
FIG. 6 is an elevational view with portions removed of a modification of the invention in the form of a screwdriver.

FIGS. 3, 4, and 5 show the details of construction of the torque device 10. A ring 15 lies within the intermediate housing 13 and is rotatable therein about the axis A—A. The ring is formed with ratchet teeth 16 on its outer periphery and with gear teeth 17 on its inner periphery. A cluster of planetary gears 18 are carried within the ring 15 and engage the gear teeth 17 on the inner periphery of the ring 15. The gears are pivotally mounted between the outer housings 11 and 12. A sun gear 19 is mounted for rotation about the axis A—A and is fixed to the first and second outer housings 11 and 12, so that it rotates with them. The sun gear is located within the cluster of gears 18 and extends axially into engagement with both the first and second housings 11 and 12. Each of the first and second outer housings has an output element in the form of a socket 21 provided with a detent element 22 for locking a socket wrench 23 in place for driving rotation with either of the outer housings 11 and 12.

As is evident in FIG. 3, the pitch diameter of each of the planetary gears 18 is substantially greater than that of the sun gear 19. The sun gear 19 is locked at its ends against relative rotation about the axis A—A relative to the first and second outer housings.

The intermediate housing 13 carries pawls 24 which on occasion engage the ratchet teeth 16 of the ring 15 to rotate the ring 15 in a first direction about the main axis. Each pawl is pivoted away from the ratchet teeth but is spring biased toward contact with them.

The gear teeth 17 on the inner periphery of the ring 15 engage the teeth of the planetary gears 18 which, in turn, engage the teeth on the sun gear 19 to rotate it and the outer housings 11 and 12 in the opposite direction to the first direction (counter-clockwise in FIG. 3).

As is evident in FIG. 4, the intermediate housing 13 carries additional pawls 25 which engage ratchet teeth 26 on the outer housing 12 to rotate the outer housing in the said opposite direction (counter-clockwise) when the intermediate housing 13 is rotated in the same direction. This means that the outer housings 11 and 12 are rotated in the counter-clockwise direction (as seen in FIG. 4) irrespective of the direction of rotation of the intermediate housing 13. It should be noted that the intermediate housing 13 also has pawls 27 (see FIG. 5) which engage ratchet teeth 28 on the outer housing 11.

It can be seen in FIG. 5 that the outer housings 11 and 12 have surfaces that face axially in opposite directions at right angles to the main axis A—A and have axial socket seats 21 adapted to receive a socket wrench 23. The change of this socket wrench from one socket seat to the other produces a driving rotation of the socket wrench in either a clockwise or a counter-clockwise direction, as desired.

The operation and advantages of the present invention will now be readily understood in view of the above description. In the preferred embodiment, the torque device is shown as a wrench for rotating and providing a torquing force couple to a socket device, such as the socket wrench 23 of FIG. 5. The arrangement is such that the movement of the handle back and forth from clockwise in one direction to counter-clockwise in the other direction produces a continuous movement of the outer housings 11 and 12 in the same direction, namely in the counter-clockwise direction as the wrench is held in FIG. 1. Referring to FIG. 3, when the handle 14 is moved in the clockwise direction, pawls 24 engage the ratchet teeth 16 on the ring 15 thus carrying the gear teeth 17 in the clockwise direction also. These gear teeth rotate the gears 18 also in the clockwise direction but this produces a counter-clockwise movement to the sun gear 19 at a much more rapid rate of rotation. Since the sun gear is locked to the first and second outer housings 11 and 12, this produces a rotation of these housings in the counter-clockwise direction. It should be noted that, when the handle 14 is moved in the clockwise direction in FIG. 4, the pawls 25 slide over the ratchet teeth 26 of the outer housing 12 and do not drive it. The same thing is true of the pawls 27; they are arranged relative to the ratchet teeth 28 on the outer housing 11 in such a way that, when the handle is rotated in the clockwise direction, the pawls simply slide over the ratchet teeth and do not drive them.

When the handle 14 is moved in the counter-clockwise direction, the pawls 24 simply slide over the ratchet teeth 6 and do not drive them. On the other hand, when the handle is moved in the counter-clockwise direction in FIG. 4, the pawls 25 engage the ratchet teeth 26 and thus drive the outer housing 12. The same thing is true in the upper part of the intermediate housing 13 where the pawls 27 engage the ratchet teeth 28 on the outer housing 11 in driving relationship and drive the outer housing 11 also. The housings 11 and 12 in this mode (when the handle 14 is moved in the counter-clockwise direction) move also in the counter-clockwise direction. Thus, no matter which direction the handle 14 is rotated, the outer housings 11 and 12 move in the counter-clockwise direction. This means that continuous torquing pressure is brought to bear between the socket wrench 23 and the element to be rotated, such as a bolt or nut. In this way, the nut is not allowed to reverse on the return stroke, as is normally true with conventional socket wrenches. Furthermore, there is no loosening and attendant shock when torquing is applied intermittently as is true with conventional torquing wrenches. The result is that neither the driven element or the socket wrench 23 is damaged by any repeated loose engagement between the two.

In addition, because the torquing takes place in the same direction (as the handle 14 is moved back and forth through an angle of say 30°), the work takes place much more rapidly. This is particularly true in the initial engagement of a nut or a bolt with a threaded nut or bolt, because the back motion of the conventional wrench tends to cause the nut to unscrew on the return stroke. Therefore, it takes much longer, when using a conventional wrench, to cause the nut to move onto a threaded bolt. In order to stop the nut from unthreading on the return stroke of the wrench handle, it was necessary to place the fingers on the nut and hold it on the return stroke so that the drag did not unthread it. It was not only an uncomfortable operation to perform, but, in some circumstances, one that was extremely dangerous.

Referring to FIGS. 6–9, a modified form of the torque device, indicated generally by the reference numeral 110, is shown as a screwdriver comprising a first outer disk-shaped housing 111 and a second outer disk-shaped housing 112, which housings are located in a generally-parallel, spaced relationship. A handle 113 envelopes and is indirectly connected to the first and second housings. The handle has a comfortable shape for rotating it about a main axis.

Means is provided joining the handle 113 to both outer housings 111 and 112 to rotate them in a second direction when the intermediate housing is rotated in a first direction. Means is also provided joining the handle to the outer housings to rotate both outer housings in the second direction when the intermediate housing is rotated in the second direction. A magnet 114 holds the housings 111 and 112 and the ring 115 within a cylindrical rocket or bore in the handle.

Figure 7:
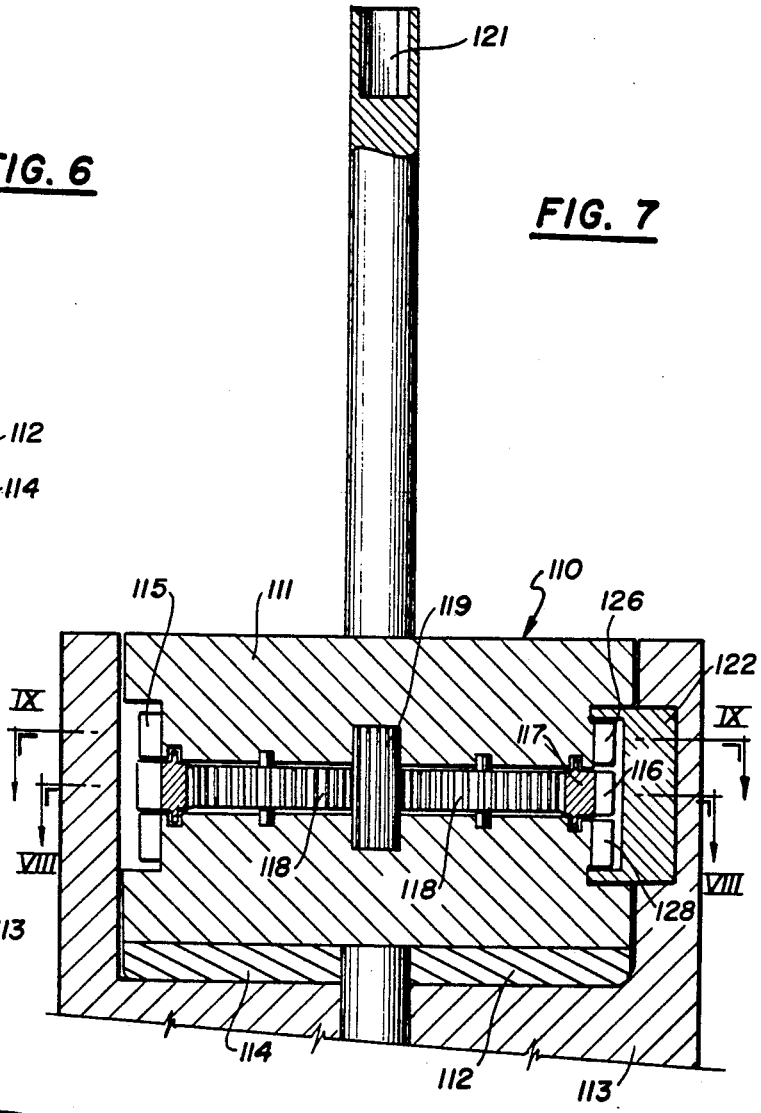
FIG. 7 is a vertical sectional view of the screwdriver taken on the line VII—VII of FIG. 6.
Figure 8:
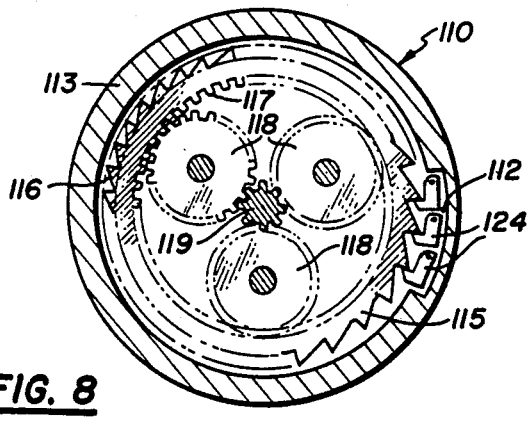
FIG. 8 is a horizontal sectional view of the screwdriver taken on the line VIII—VIII of FIG. 7.
Figure 9:
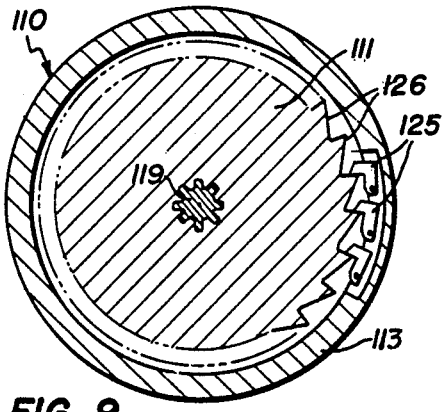
FIG. 9 is a horizontal sectional view of the screwdriver taken on the line IX—IX of FIG. 7.

FIGS. 7, 8, and 9 show the details of construction of the torque device 110. A ring 115 lies within the handle and is rotatable therein about the main axis. The ring is formed with ratchet teeth 116 on its outer periphery and with gear teeth 117 on its inner periphery. A cluster of planetary gears 118 are carried within the ring 115 and engage the gear teeth 117 on the inner periphery of the ring 115. The gears are pivotally mounted between the outer housings 111 and 112. A sun gear 119 is mounted for rotation about the main axis and is fixed to the first and second outer housings 111 and 112, so that it rotates with them. The sun gear is located within the cluster of gears 118 and extends axially into engagement with both the first and second housings 111 and 112. Each of the first and second outer housings has an output element in the form of a screwdriver blade with a socket 129 provided with a shape for locking a blade 123 in place for driving rotation with either of the outer housings 111 and 112.

As is evident in FIG. 8, the pitch diameter of each of the planetary gears 118 is substantially greater than that of the sun gear 119. The sun gear 119 is locked at its ends against relative rotation about the main axis relative to the first and second outer housings.

The handle 113 carries a block 122 with pivotal pawls 124 which on occasion engage the ratchet teeth 116 of the ring 115 to rotate the ring 115 in a first direction about the main axis. Each pawl is pivoted away from the ratchet teeth but is spring biased toward contact with them.

The gear teeth 117 on the inner periphery of the ring 115 engage the teeth of the planetary gears 118 which, in turn, engage the teeth on the sun gear 119 to rotate it and the outer housings 111 and 112 in the opposite direction to the first direction (clockwise in FIG. 8).

As is evident in FIG. 9, the handle 113 carries additional pawls 125 which engage ratchet teeth 126 on the outer housing 111 to rotate the outer housing in the said opposite direction (clockwise) when the handle 113 is rotated in the same direction. This means that the outer housings 111 and 112 are rotated in the clockwise direction (as seen in FIG. 9) irrespective of the direction of rotation of the intermediate housing 113. It should be noted that the handle 113 also has pawls 127 which engage ratchet teeth 128 on the outer housing 112.

It can be seen in FIG. 7 that the outer housings 111 and 112 have surfaces that face axially in opposite directions at right angles to the main axis and have screwdriver shafts 121 having hexagonal sockets adapted to receive blades 123. The change from one shaft to the other produces a driving rotation in either a clockwise or a counter-clockwise direction, as desired.

The operation and advantages of the screwdriver will now be readily understood in view of the above description. In the preferred embodiment, the screwdriver is shown as having replaceable blades for rotating and providing a torquing force couple to a device, such as a screw or bolt. The arrangement is such that the movement of the handle 113, back and forth from clockwise in one direction to counter-clockwise in the other direction produces a continuous movement of the outer housings 111 and 112 in the same direction, namely in the clockwise direction as the screwdriver is held in FIG. 8. Referring to FIG. 8, when the handle 113 is moved in the counter-clockwise direction, pawls 124 engage the ratchet teeth 116 on the ring 115 thus carrying the gear teeth 117 in the counter-clockwise direction also. These gear teeth rotate the gears 118 also in the counter-clockwise direction but this produces a clockwise movement to the sun gear 119 at a much more rapid rate of rotation. Since the sun gear is locked to the first and second outer housings 111 and 112, the housings are also moved in the same direction. It should be noted that, when the handle 113 is moved in the counter-clockwise direction in FIG. 9, the pawls 125 slide over the ratchet teeth 126 of the outer housing 111 and do not drive them. The same thing is true of lower pawls (not shown). They are arranged relative to the ratchet teeth on the outer housing 112 in such a way that, when the handle 113 is rotated in the counter-clockwise direction, the pawls simply slide over the ratchet teeth and do not drive them.

When the handle 113 is moved in the clockwise direction, the pawls 124 simply slide over the ratchet teeth 116 and do not drive them. On the other hand, when the handle is moved in the clockwise direction in FIG. 9, the pawls 125 engage the ratchet teeth 126 and thus drive the outer housing 111. The same thing is true in the lower part of the handle 113, where the pawls engage the ratchet teeth 128 on the outer housing 112 in driving relationship and drive the outer housing 112 also. The outer housings 111 and 112 in this mode (when the handle 113 is moved in the counter-clockwise direction) move in the clockwise direction. Thus, no matter which direction the handle 113 is rotated, the outer housings 111 and 112 move in the clockwise direction. This means that continuous torquing pressure is brought to bear between the blade and the element to be rotated, such as a screw. In this way, the screw is not allowed to reverse on the return stroke, as is normally true with conventional screwdrivers. Furthermore, there is no loosening and attendant shock when torquing is applied intermittently as is true with conventional screwdrivers. The result is that neither the driven element or the blade 123 is damaged by any repeated loose engagement between the two.

In addition, because the torquing takes place in the same direction (as the handle 113 rotates back and forth through an angle of say 30°), the work takes place much more rapidly. This is particularly true in the initial engagement of a bolt with a threaded hole, because the back motion of the conventional screwdriver tends to cause the bolt to loosen on the return stroke. Therefore, it takes much longer, when using a conventional screwdriver, to cause the bolt to move into the hole. In order to stop the bolt from unthreading on the return rotation of the screwdriver handle, it was formerly necessary to place the fingers on the bolt and to hold it on the return rotation, so that the drag did not unthread it. It was not only uncomfortable operation to perform, but, in some circumstances, one that was dangerous.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Torque device, comprising:

(a) first and second outer housings located in spaced relationship, (b) a third intermediate housing lying between and joining the first and second housings, the intermediate housing having means for rotating it about a main axis, (c) a ring lying within the intermediate housing and rotatable therein about the said main axis, the ring being formed with ratchet teeth on its outer periphery and with gear teeth on its inner periphery, (d) a cluster of planetary gears carried within the ring and engaging the gear teeth of the ring, and (e) a sun gear located within the cluster for rotation about the main axis and extending axially into engagement with both the first and second housings, wherein each of the first and second outer housings has an output element centered on the main axis and extending axially in the direction away from the intermediate housing.

2. Torque device as recited in claim 1, wherein the pitch diameter of each of the planetary gears is substantially greater than that of the sun gear.

3. Torque device as recited in claim 1, wherein the sun gear is locked at its ends against relative rotation about the axis relative to the first and second outer housings.

4. Torque device as recited in claim 1, wherein the intermediate housing carries pawls which engage the ratchet teeth on the outer periphery of the ring to rotate the ring in a first direction about the main axis.

5. Torque device as recited in claim 4, wherein the gear teeth on the inner periphery of the ring engage the teeth of the planetary gears, which in turn engage the teeth on the sun gear to rotate it and the outer housings in the opposite direction to the first direction.

6. Torque device as recited in claim 5, wherein the intermediate housing carries pawls which engage ratchet teeth on the outer housings to rotate the outer housings in the said opposite direction when the intermediate housing is rotated in the opposite direction, so that the outer housings are rotated in the said opposite direction, irrespective of the direction of rotation of the intermediate housing.

7. Torque device as recited in claim 6, wherein the outer housings have surfaces that face axially in opposite directions, each surface having an axial opening to receive a socket element, the change of a socket element from one opening to the other producing selective driving rotation of the socket element in clockwise or counter-clockwise direction.

8. Torque device, comprising:

(a) first and second outer disk-shaped housings located in generally parallel, spaced relationship, (b) a third annular intermediate housing sandwiched between and joining the first and second housings, the intermediate housing having a radial handle for rotating it about a main axis, (c) means joining the intermediate housing to both outer housings to rotate them in a second direction when the intermediate housing is rotated in a first direction, and (d) means joining the intermediate housing to rotate both outer housings in the second direction when the intermediate housing is rotated in the second direction.

9. A screwdriver, comprising:

(a) first and second outer housings located in spaced relationship, (b) a handle surrounding and indirectly joining the first and second housings, the handle having a gripping surface for rotating it about a main axis, (c) a ring lying within the handle and rotatable therein about the said main axis, the ring being formed with ratchet teeth on its outer periphery and with gear teeth on its inner periphery, (d) a cluster of planetary gears carried within the ring and engaging the gear teeth of the ring, and (e) a sun gear located within the cluster for rotation about the main axis and extending axially into engagement with both the first and second housings, wherein the first and second outer housings have blades centered on the main axis and extending axially in opposite directions.

10. A wrench, comprising:

(a) first and second outer housings located in spaced relationship, (b) a third intermediate housing lying between and joining the first and second housings, the intermediate housing having a radial handle for rotating it about a main axis, (c) a ring lying within the intermediate housing and rotatable therein about the said main axis, the ring being formed with ratchet teeth on its outer periphery and with gear teeth on its inner periphery, (d) a cluster of planetary gears carried within the ring and engaging the gear teeth of the ring, and (e) a sun gear located within the cluster for rotation about the main axis and extending axially into engagement with both the first and second housings, wherein the first and second outer housings have sockets centered on the main axis and facing axially in opposite directions.

* * * * *